US007378813B2

(12) United States Patent
Scheer et al.

(10) Patent No.: US 7,378,813 B2
(45) Date of Patent: May 27, 2008

(54) METHOD AND DEVICE FOR DETERMINING THE ZERO POSITION OF A YARN GUIDE CAPABLE OF CROSS-WINDING

(75) Inventors: Günter Scheer, Mönchengladbach (DE); Wilhelm Oehrl, Erkelenz (DE); Erwin Peters, Düren (DE); Robert Geisler, Willich (DE); Dirk Schiffers, Korschenbroich (DE); Gudrun Doβ, Wegberg (DE); Maximilian Preutenborbeck, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 354 days.

(21) Appl. No.: 11/324,985

(22) Filed: Jan. 3, 2006

(65) Prior Publication Data

US 2006/0157609 A1 Jul. 20, 2006

(30) Foreign Application Priority Data

Jan. 19, 2005 (DE) ..... 10 2005 002 409

(51) Int. Cl.
*H02P 8/00* (2006.01)
*B65H 54/38* (2006.01)

(52) U.S. Cl. ..... 318/685; 318/6; 318/686; 318/696; 242/477.2; 242/478.2; 242/478.5

(58) Field of Classification Search ..... 318/6, 318/7, 685, 686, 696; 242/478.2, 477.5, 242/477.2

See application file for complete search history.

(56) References Cited

U.S. PATENT DOCUMENTS

| | | | | |
|---|---|---|---|---|
| 4,132,368 | A * | 1/1979 | Schiess et al. | 242/364.8 |
| 4,948,057 | A | 8/1990 | Greis | 242/18 R |
| 5,050,405 | A * | 9/1991 | Jacobsson | 66/132 R |
| 5,489,067 | A * | 2/1996 | Nakai et al. | 242/474.5 |
| 6,065,712 | A * | 5/2000 | Mayer et al. | 242/477.2 |
| 6,186,435 | B1 * | 2/2001 | Mayer et al. | 242/477.2 |
| 6,241,177 | B1 * | 6/2001 | Schroter et al. | 242/476.2 |
| 6,283,401 | B1 * | 9/2001 | Lieber et al. | 242/477.2 |
| 6,405,966 | B1 * | 6/2002 | Lieber et al. | 242/478.2 |
| 6,523,774 | B2 * | 2/2003 | Lenz et al. | 242/480.4 |

(Continued)

FOREIGN PATENT DOCUMENTS

DE 3048016 C2 7/1982

(Continued)

*Primary Examiner*—Paul Ip
(74) *Attorney, Agent, or Firm*—Kennedy Covington Lobdell & Hickman, LLP

(57) ABSTRACT

A system for determining a zero position of a yarn guide (25) of a textile winding device for cross-winding yarn into cheeses via a step motor (34). The yarn guide (25), acted upon by the step motor (34), is initially displaced in the direction of its zero position (NS) and positioned at a slow speed against a defined detent (15) downstream of the zero position (NS). Then, the step motor (34) is switched off, causing the rotor (41) of the step motor (34) to drop into one of two possible stop positions (RS1, RS2). Subsequently, the step motor (34) is switched on by an electrical current supply to its stator windings (20A, 20B) such that, when switched off, the rotor (41) of the step motor (34) is in the stop position (RS2) in which the yarn guide (25) is in its zero position (NS).

11 Claims, 5 Drawing Sheets

U.S. PATENT DOCUMENTS

2002/0043585 A1* 4/2002 Lenz et al. ..... 242/480.4

FOREIGN PATENT DOCUMENTS

DE 3734478 A1 4/1989
DE 293 923 A5 9/1991
DE 694 14 045 T2 4/1999
DE 100 21 963 12/2000
DE 199 63 232 A1 7/2001
DE 10 2004 003 173 A1 8/2005
EP 1 126 058 A2 8/2001

* cited by examiner

METHOD AND DEVICE FOR DETERMINING THE ZERO POSITION OF A YARN GUIDE CAPABLE OF CROSS-WINDING

CROSS-REFERENCES TO RELATED APPLICATIONS

This application claims the benefit of German patent application DEP102005002409.2 filed Jan. 19, 2005, herein incorporated by reference.

BACKGROUND OF THE INVENTION

The present invention relates to a method and apparatus for determining a zero position of a yarn guide of a winding device of a textile machine producing cheeses, and relates more particularly to such a textile machine which is capable of cross-winding cheeses by means of a step motor.

For producing a textile bobbin, it is known to be necessary, on the one hand, to put the respective textile bobbin into rotation and, on the other hand, to cross-wind the yarn running up on the bobbin along the bobbin axis. By means of a relatively rapid cross-winding of the yarn, it is possible to produce a so-called cross-wound textile bobbin, which is not only distinguished by a comparatively stable bobbin body, but also by good unwinding properties.

In connection with the production of such cheeses, there are already different yarn placement systems in actual use, which are extensively described in numerous patent applications.

For example, in connection with bobbin-winding machines operated at relatively high winding speeds, the use of so-called yarn guide drums as yarn cross-winding devices is widespread. Such yarn guide drums have a groove for cross-winding the yarn and at the same time they drive the textile bobbin by frictional contact. However, such yarn guide drums, which have proven themselves per se, are relatively expensive to produce and, because of the limits of the system, can only be used for producing cheeses of the "random cross-wound" type, since for producing a so-called "precision," or "stepped precision winding," the drive mechanism of the cheese and the drive mechanism of the-yarn cross-winding device must be separate.

Different yarn cross-winding devices are known in connection with winding heads which respectively have a separate drive mechanism for rotating the take-up bobbin and a separate drive mechanism for cross-winding the arriving yarn. For example, cross-winding devices are known which have a yarn guide which can be shifted parallel with the axis of rotation of the cheese and are for example connected via traction means with a reversible individual drive mechanism. Installations are furthermore known which operate with a so-called finger yarn guide, i.e. a yarn guide which has a finger-like yarn displacement lever, which is pivotable-through a specific angular range around an axis which is arranged substantially perpendicularly in relation to the cheese axis.

Yarn cross-winding devices with a yarn guide which can be shifted parallel in relation to the axis of rotation of the cheese have been described, for example, in German Patent Publication DE 37 34 478 A1, in German Patent Publication DE 100 21 963 A1 or in the later published German Patent Publication DE 10 2004 003 173.8.

The yarn cross-winding device described in German Patent Publication DE 37 34 478 A1 has a yarn guide which is guided on a yarn guide rod in the cross-winding area and is driven via endless traction means by a microprocessor-controlled step motor.

A yarn cross-winding device is also described in the later published German Patent Publication DE 10 2004 003 173.8, whose yarn guide is guided on a yarn guide rod and is connected via a toothed belt with a reversible individual drive mechanism. Here, the yarn guide rod, the gear wheels for the toothed belt, as well as the associated individual drive mechanisms are arranged in a housing which is closed to the greatest possible extent. This means that the interior of this yarn cross-winding device, embodied as a modular structural component, is sealed at the front by the endless traction means.

A yarn cross-winding device with a cross-winding yarn guide which is fixed on an endless belt and can be operated by an individual drive mechanism is furthermore described in German Patent Publication DE 100 21 963 A1. Here, the individual drive mechanism of the yarn guide can be controlled in such a way that a cross-winding stroke can be performed which can be changed in length. To this end, the individual drive mechanism of the cross-winding yarn guide is equipped with an angle encoder which detects the rotor position of the electric motor and reports the detected rotor position to a corresponding work station control.

However, in connection with the above-mentioned generally advantageous yarn cross-winding devices, the comparatively large control outlay, which is performed for assuring a correct traversing of a yarn, is disadvantageous. Thus, the known yarn cross-winding devices have relatively elaborate, and therefore expensive control and monitoring devices.

SUMMARY OF THE INVENTION

In view of the above described known winding devices, it is an object of the present invention to provide a method and a device which overcomes the disadvantages mentioned. A more particular object is to make possible an assured and accurate cross-winding of a yarn being wound onto a cheese, wherein the expenditure for control means should be as low as possible.

In accordance with the invention, this object is addressed by a method for determining a zero position of a yarn guide device of a winding device of a textile machine which is operative for cross-winding a yarn by means of a step motor for producing yarn cheeses. The method basically comprises the steps of, first, displacing an element of the yarn guide device by the step motor in the direction of the zero position, and positioning the element of the yarn guide device at a comparatively slow speed against a defined detent arranged downstream of the zero position in the direction of the displacement. The step motor is then switched off for positioning a rotor of the step motor into one of two possible stop positions. Then, the step motor is switched on by a definite electrical current supply to stator windings of the step motor such that, when again switched off, the rotor of the step motor is in the stop position in which the yarn guide is in its zero position.

The method of the present invention has the particular advantage of assuring in a simple manner, i.e. without additional sensor devices or the like, that at the beginning of the cross-winding process the yarn guide can always be started from a defined position. In connection with a step motor, it is assured that the cross-winding process can be correctly performed, i.e. that in the course of cross-winding the incoming yarn, the yarn guide is always in the right position at the right time.

As mentioned above, no additional sensor devices are required for executing the method in accordance with the invention, only hardware or software, which is needed anyway for operating a yarn guide which can perform cross-winding by means of a step motor. Thus, the method in accordance with the invention can be realized quite cost-efficiently.

In an advantageous embodiment, an apparatus for executing the method in accordance with the invention has a yarn guide drive embodied as hybrid step motor. The rotor of this hybrid step motor is equipped with an axially magnetized permanent magnet and has salient poles in the form of toothed pole caps in each rotor end. Rotors designed in this way with a relatively large number of poles in the area of their pole caps lead to small angular steps during the operation of the step motor which, on the one hand, has a positive effect on the rotation of the step motor and, on the other hand, leads to a multitude of so-called stop positions of the rotor when the step motor is switched off. Thus, a step motor designed in this way is distinguished, on the one hand, by good rotation, but can also be sensitively positioned in a pre-defined stop position when needed.

The rotation of the step motor can be further optimized in a simple manner by arranging the poles of the first pole cap in an angularly offset manner in respect to the poles of the second pole cap.

In an advantageous embodiment, the angular offset between the poles of the first pole cap and the poles of the second pole cap may be half a divisional spacing between the poles, which is effective, together with continuous magnetic stator poles, for halving of the increments of the respective angular steps of the motor and therefore to a very even rotation of the step motor.

In a preferred embodiment, it is furthermore provided that the stator of the hybrid step motor has a multitude of stator segments, each of which is enclosed by windings which can be charged with electrical current. In this case, one half of the windings is connected to a first phase of a d.c. current source, while the other half of the windings is in connection with a second phase. Thus, the stator segments on the circumference of the stator which are supplied with electrical current via the first phase alternate with stator segments connected to the second phase. Charged appropriately by means of a control, such a step motor runs dependably in bipolar operation.

The stator segments preferably have pole teeth which, in accordance with the electrical current supply of the windings of the stator segments, correspond with the poles, of the pole caps of the rotor. Thus, when the windings of the stator segments are supplied with electrical current, the N-poles of the front pole cap of the rotor, as well as the S-poles of the rear pole cap of the rotor are affected.

In a further design of the invention, it may be furthermore provided that a toothed drive wheel is placed, fixed against relative rotation, on the motor shaft of the step motor, which drives a toothed belt with a tooth spacing of preferably 2 mm. In an advantageous embodiment, the drive wheel here has 48 teeth, for example.

Such a design of the mechanical drive elements assures that every movement of the step motor which relates to the cross-winding range, the cross-winding width or the cross-winding speed, is exactly converted, i.e. without slippage. Correct yarn cross-winding, as well as a sufficiently exact positioning of the yarn guide in its zero position, is possible in this way in connection with hybrid step motors.

BRIEF DESCRIPTION OF THE DRAWINGS

The invention will be described in greater detail in the following disclosure with reference to an exemplary embodiment represented in the accompanying drawings, wherein.

DESCRIPTION OF THE PREFERRED EMBODIMENT

Figure 1:
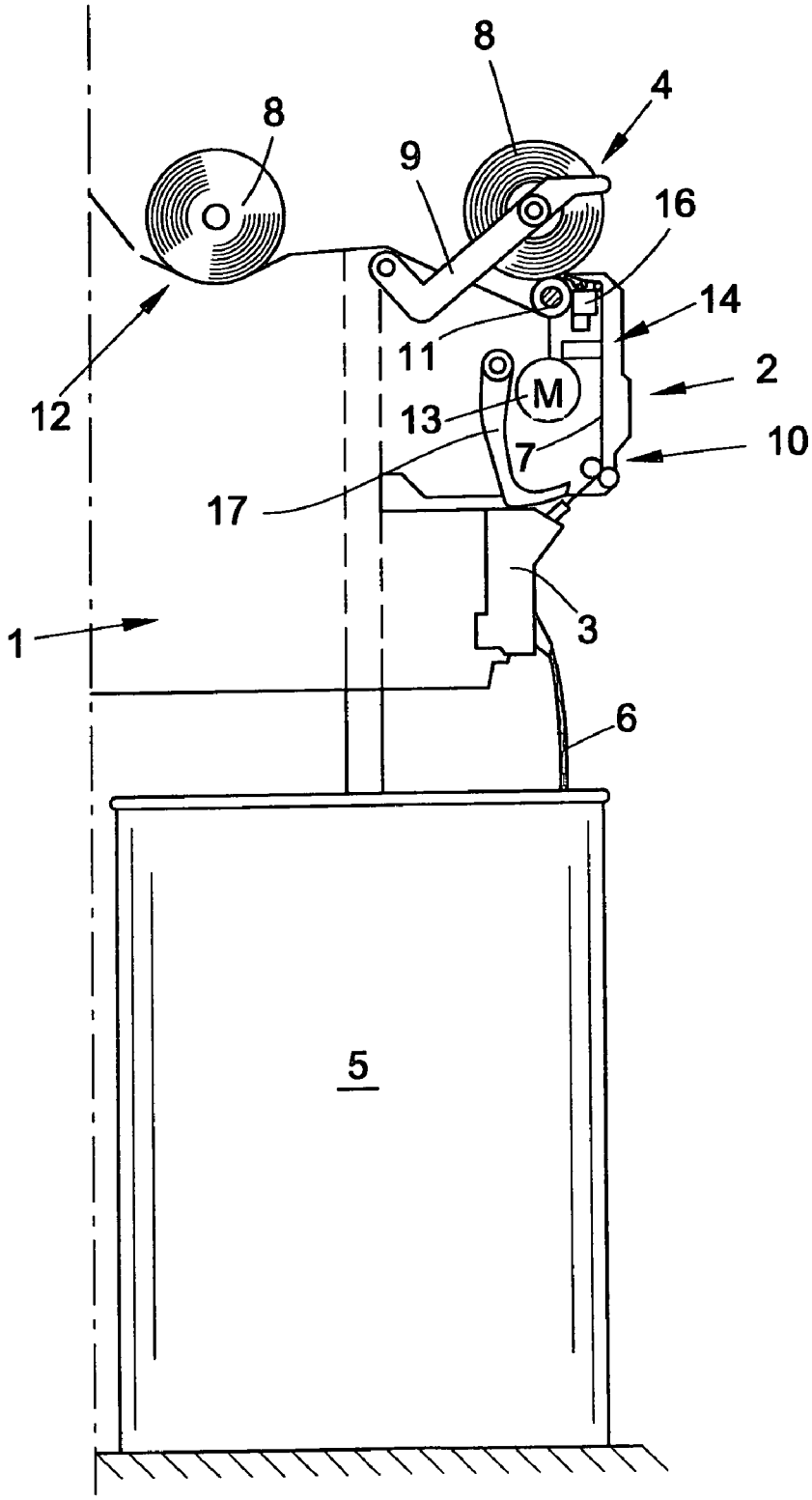
FIG. 1 is a lateral view of a work station of a cheese-producing textile machine with a yarn cross-winding device in accordance with the present invention in the area of the bobbin-winding device.

Referring now to the accompanying drawings, one side (i.e., one half) of a cheese-producing textile machine 1, in the exemplary embodiment an open-end rotor spinning machine, is schematically represented in a lateral end view in FIG. 1.

As known, such textile machines have multiple identical work stations 2 arranged side-by-side between their end frames (not represented). In this case, each of the work stations 2 has a spinning unit 3, as well as a bobbin-winding device 4. Slivers 6 stored in sliver cans 5 are processed into yarn 7 in the spinning units 3 and are subsequently wound into cheeses 8 on the bobbin-winding devices 4. The finished cheeses 8 are conveyed via a cheese transport installation 12 to a loading station (not represented) arranged at the machine.

As indicated in FIG. 1, the work stations 2 each have still further manipulating arrangements besides the spinning unit 3 and the bobbin-winding device 4, for example a yarn draw-off device 10, a suction nozzle 17, or a waxing device 14. The functions of these components are known and extensively explained in numerous patent publications, and therefore need not be explained herein.

The bobbin-winding device 4 has a creel 9, a bobbin drive roller 11, as well as a yarn cross-winding device 16. The bobbin drive roller 11, which can be driven by a drive mechanism 13 with an individual motor, drives the cheese 8, which is seated in a freely rotatable manner in the creel 9, by friction.

Figure 2:
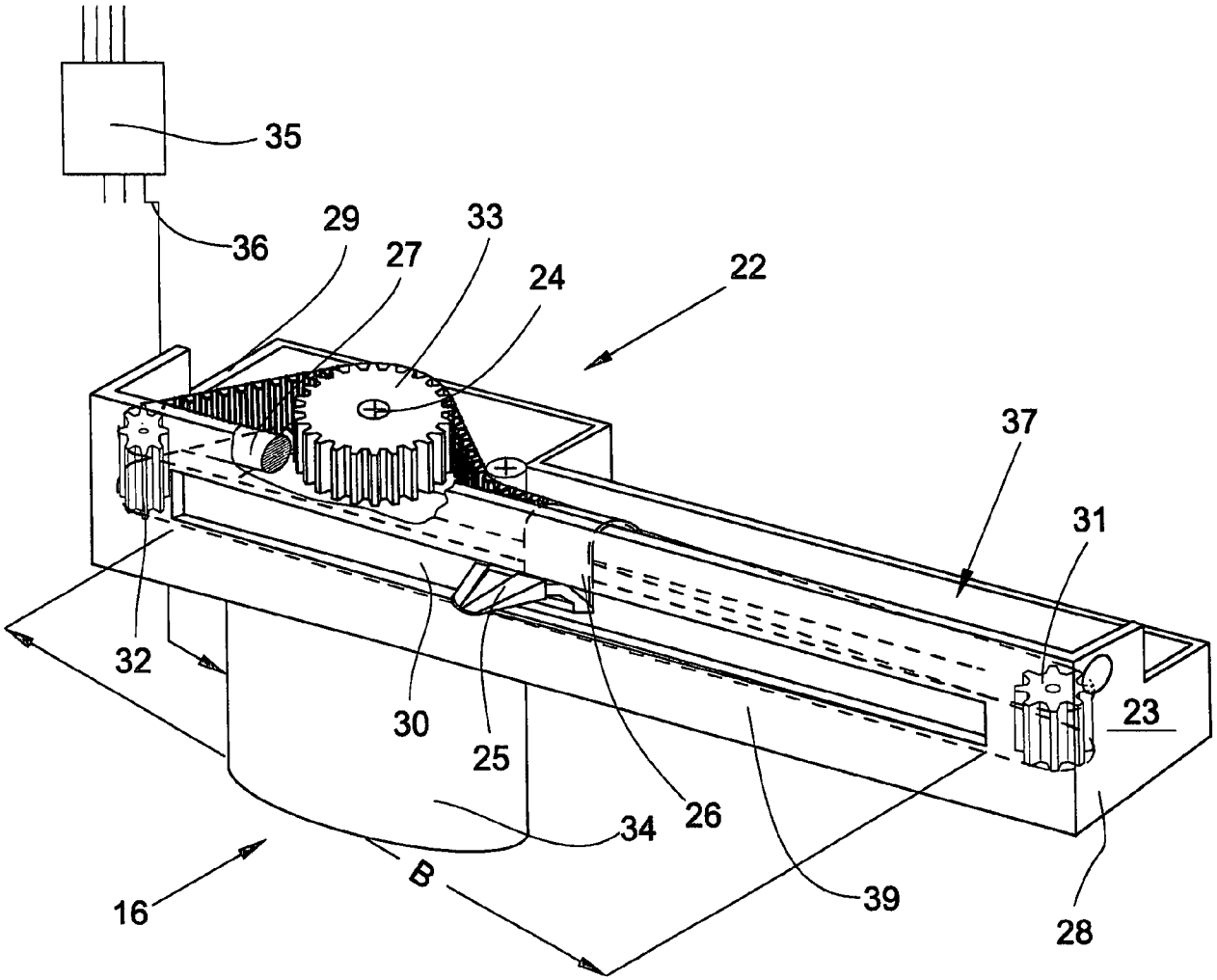
FIG. 2 is a top perspective view in an enlarged scale of a yarn cross-winding device in accordance with the present invention.

The yarn cross-winding device 16, such as respectively arranged in the area of the bobbin-winding device 4 of the numerous work stations 2 of the textile machine 1, is shown in detail in FIG. 2.

FIG. 2 here shows a top perspective view of a yarn cross-winding device 16 embodied as a modular yarn guide unit 22 and sealed to the greatest extent. That is, the interior 37 of the housing 23 of the yarn guide unit 22 is sealed off at the front by the endless traction means 30, can be covered at the top by means of a cover element (not represented) and is then protected to the greatest extent against the penetration of textile dust and flying fibers.

As can be further seen, the yarn guide 25, which is made in the customary way from a wear-resistant material, preferably an oxide ceramic material, is fastened to a guide shoe 26, which in turn is slidingly conducted on a guide element 27. In this case the sliding element 27 itself is fixed on the lateral walls of the yarn guide unit 22. The guide shoe 26 is furthermore fastened on the exterior of an endless traction means, preferably a toothed belt 30 which, as indicated, is guided via direction-reversing wheels 31, 32 arranged laterally next to the cross-winding section B of the yarn guide 25, as well as a drive wheel 33.

The drive wheel 33 is arranged, fixed against relative rotation, on the motor shaft 24 of a reversible electric motor drive mechanism, preferably a hybrid step motor 34, which is connected via a control line 36 to a control computer 35, for example a central computer of the textile machine.

In an alternative embodiment, it is of course also possible to employ a section computer or a separate work station computer as the control computer 35.

Figure 3:
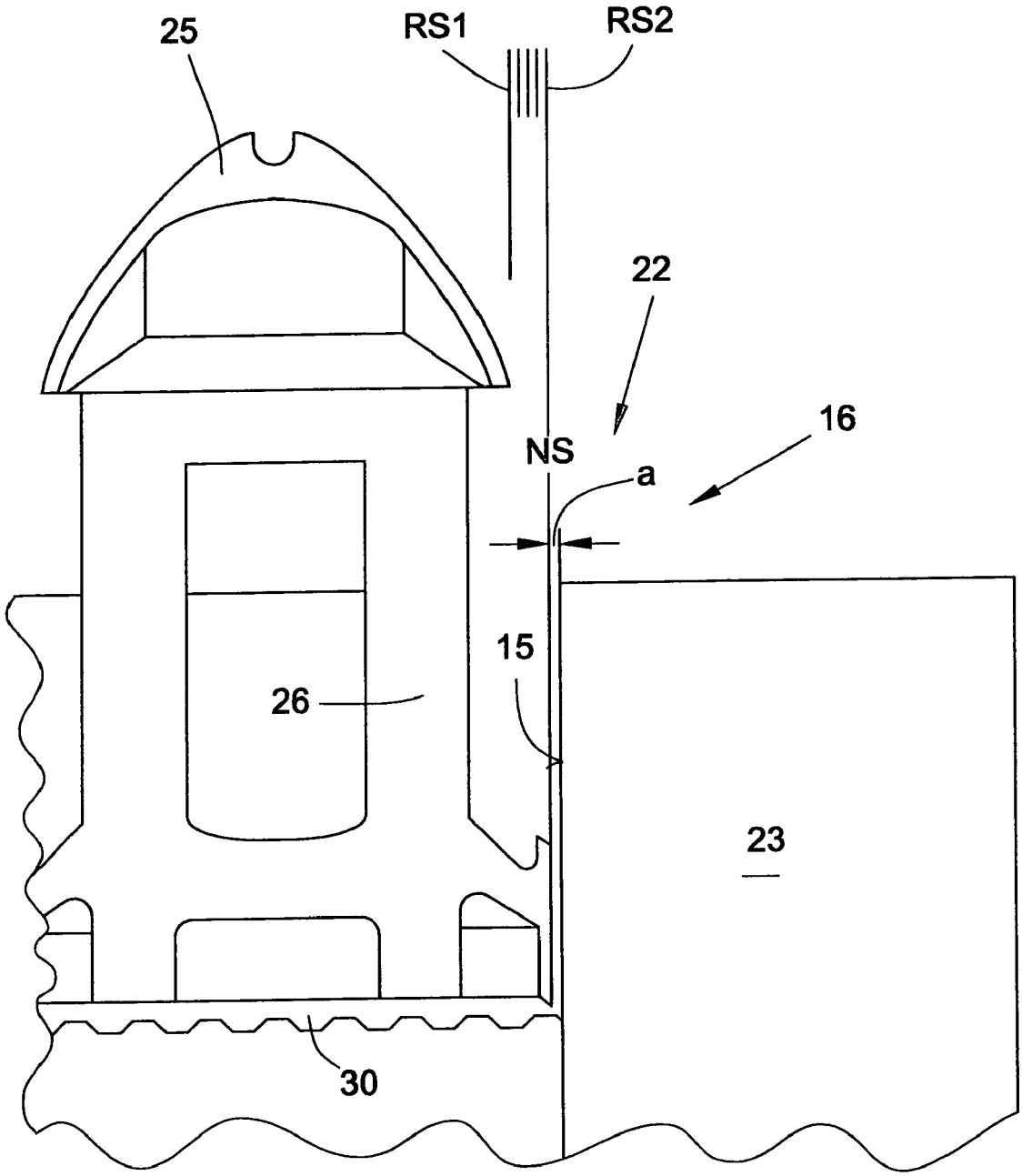
FIG. 3 depicts the yarn guide of the yarn cross-winding device in accordance with FIG. 2 in its zero position.

FIG. 3 shows the yarn guide 25 in its zero position NS, i.e. in a defined position at a distance a in respect to a run-up edge 15 of the housing 23 of the yarn guide unit 22. This zero position NS respectively represents the initial position of the yarn guide 25, and therefore of the step motor 34' prior to the start of a cross-winding process, or during a fresh start of the yarn cross-winding device 16.

Figure 4:
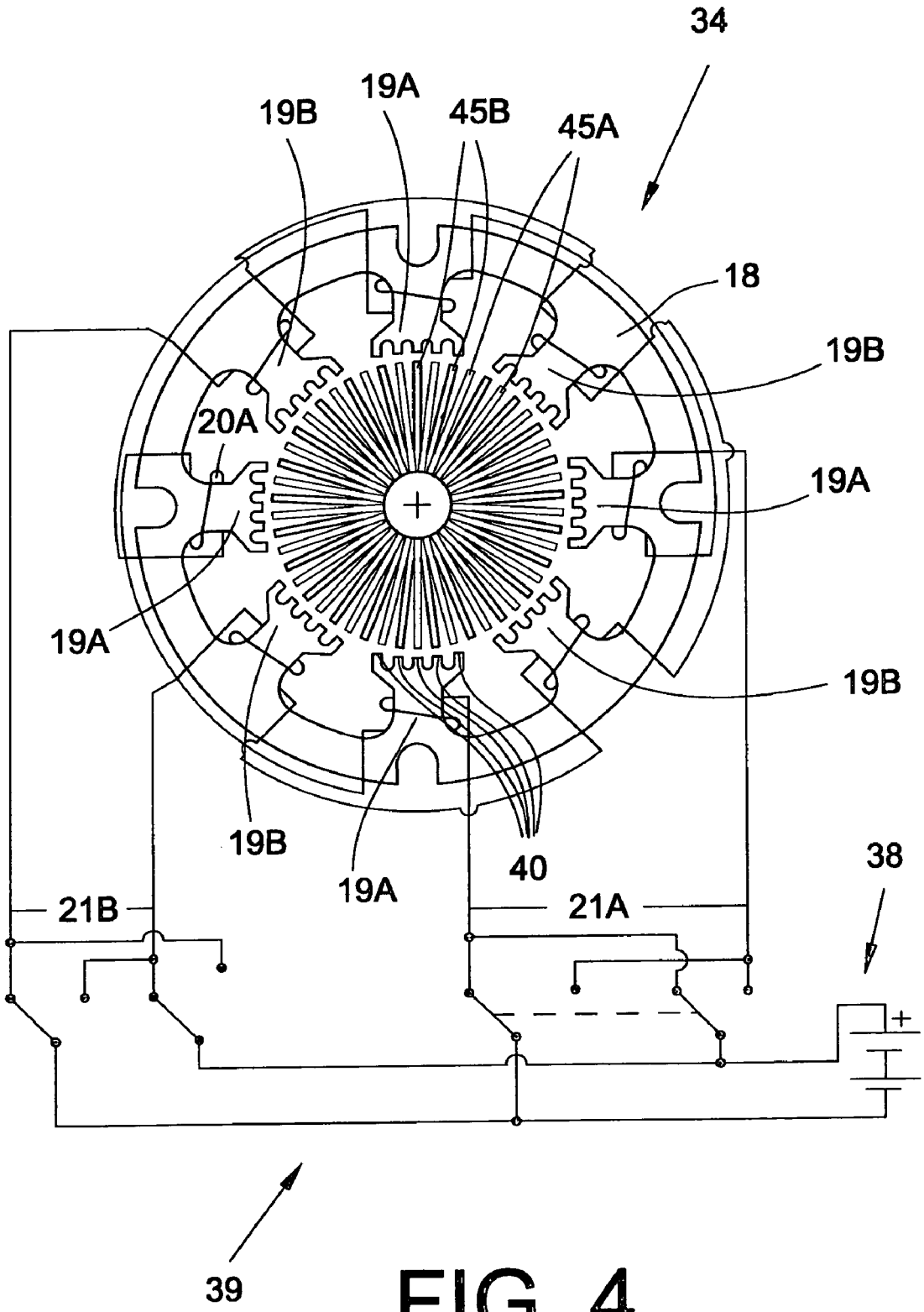
FIG. 4 is a front view of a yarn guide drive mechanism designed as a hybrid step motor with the front motor cover removed.

FIG. 4 shows a front view of a yarn guide drive mechanism designed as a hybrid step motor 34. As can be seen, the stator 18 has eight stator segments 19A and 19B with salient (toothed) poles 40. Each of the stator segments 19A and 19B is here surrounded by windings 20A or 20B, which can be supplied with electrical current. In this case, the windings 20A of the stator segments 19A are connected to a d.c. current source 38 via a first electrical current phase 21A, while the windings 20B of the stator segments 19B are connected to the d.c. current source 38 via a second electrical current phase 21B.

The circuit arrangement 39 is designed such that bipolar operations are possible, i.e. that the magnetization of the teeth 40 arranged on the stator segments 19A and 19B can be selectively switched to the N-pole or the S-pole.

Figure 5:
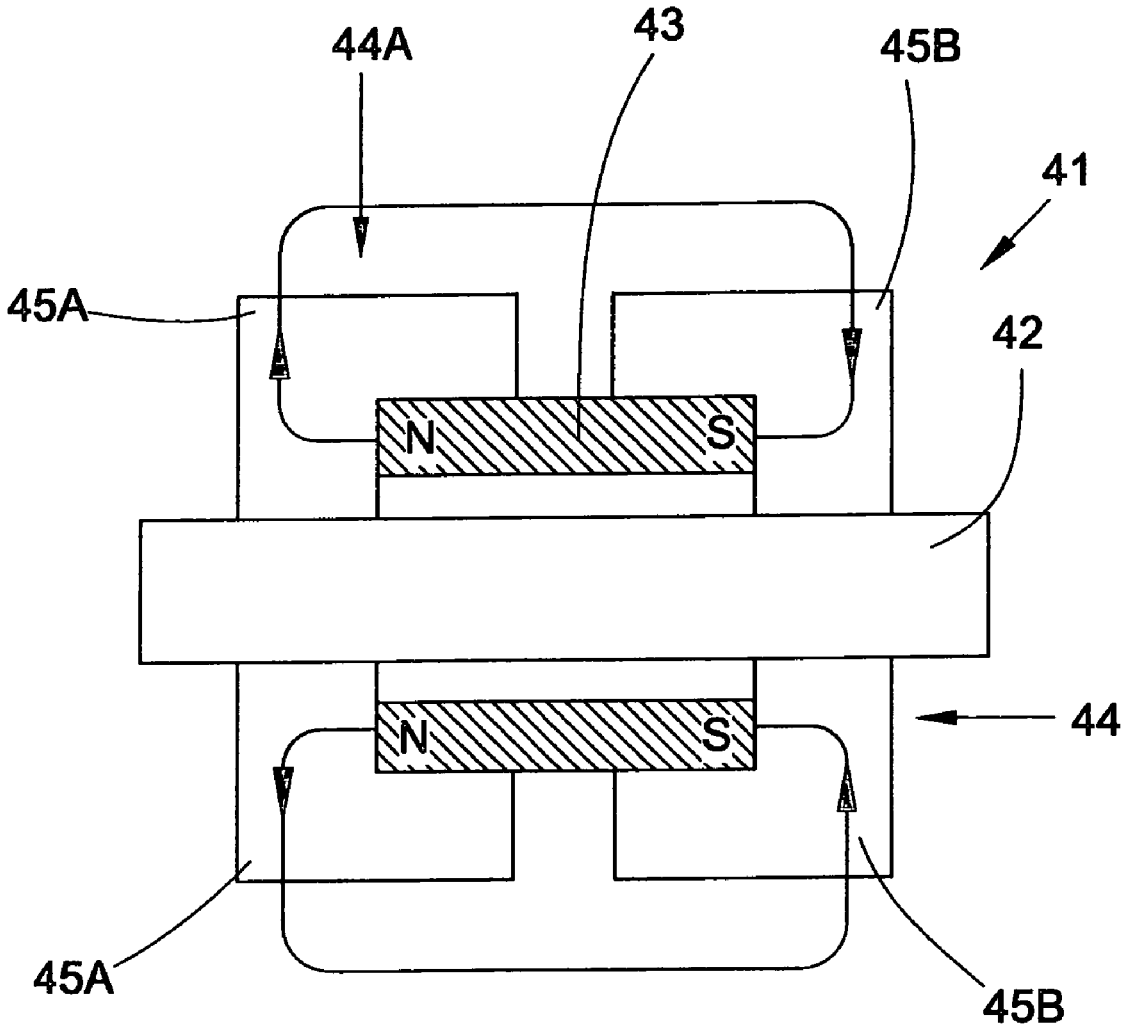
FIG. 5 depicts the rotor of the hybrid step motor of FIG. 4 in a lateral view and partially in section.

As represented in FIG. 5, the rotor 41 substantially consists of a motor shaft 42, an axially magnetized, preferably ring-shaped bipolar permanent magnet 43, as well as two, also toothed pole caps 44A and 44B. For example, the teeth 45A of the pole cap 44A are N-poles, while the teeth 45B of the pole cap 44B form S-poles. Moreover, the teeth 45A of the pole cap 44B are offset by half a tooth division in respect to the teeth 45B of the pole cap 44B.

The method in accordance with the present invention is carried out as follows. In connection with the embodiment selected for the exemplary embodiment of a hybrid step motor 34 with respectively twenty-five teeth per pole cap, as well as two-phase operation, the following relationship applies in regard to the number z of steps of the motor in accordance with the equation: $z=k\times p$, wherein $k=2\times m_s$, and $m_s$ represents the number of phases of the stator, as well as p=the number of poles of the rotor, $z=2\times2\times50=200$ single steps per rotor revolution.

Thus, with each step, the rotor of the motor moves by the increment 360°/200 steps=1.8°.

Since the rotor has a total of fifty poles, which are respectively spaced apart by 7.2°, four individual steps are required between the individual poles.

Moreover, in connection with the teeth at the stator element, the fifty poles of the rotor respectively form a so-called stop moment, i.e. a defined position at which the rotor stops as soon as the motor current is switched off.

Furthermore, in the exemplary embodiment, a displacement path s per motor step=path steps=2 mm×48/200=0.48 mm results for the yarn guide arranged on the motor shaft of the step motor from the divisional spacing of the toothed belt connecting the yarn guide with its associated drive mechanism of 2 mm, as well as from the number of teeth, forty-eight, of the drive wheel. Thus, two stop positions of the motor are respectively 4×0.48 mm=1.92 mm apart.

At the start of carrying out the present method, the yarn guide 25 is at any arbitrary distance from its desired zero position NS which, in the exemplary embodiment represented in FIG. 3, is for example located 0.2 mm in front of the run-up edge 15 of the housing 23 of the yarn guide unit 22. Initially, the yarn guide 25 is shifted by the step motor 34 slowly in the direction of this zero position NS until it is assured that it has reached or passed the zero position NS. Thus, at any arbitrary time the guide shoe 26 of the yarn guide 25 reaches the run-up edge 15 of the housing 23 and continues to run against this run-up edge 15 until the step motor 34 is switched off Upon switch-off, the rotor 41 of the step motor 34 drops into a so-called stop position.

The location of this stop position results from the type of the step motor 34, as well as from the electrical switching step in which the step motor 34 had been at the time of the switch-off, as explained above. Thus, the rotor 41 either is in the last stop position, in which the guide shoe 26 of the yarn guide 25 is placed directly against the run-up edge 15 of the housing 23, or in the next-to-last position, in which the guide shoe 26 of the yarn guide 25 is positioned spaced apart from the run-up edge 15, wherein this distance would be 1.92 mm in the exemplary embodiment, as explained above.

The step motor 34 is subsequently again charged with electrical current. Thus, the windings 20A and 20B of the stator elements 19A and 19B of the step motor 34 are controlled in such a way that the rotor 41 turns further, or attempts to turn further, by four steps of 1.8° in the direction of the last stop position, and therefore the zero position NS of the yarn guide 25.

Thus, if, at the time of the switch-on of the step motor 34, the yarn guide 25 is already in its zero position NS at the run-up edge 15 of the housing 23, the rotor 41 cannot obey the electrical control and, at the time of the subsequent switch-off of the electrical current, drops back again into the last stop position.

However, if, at the time of switching-on of the electrical current, the rotor 41 is positioned in the next-to-last stop position, the rotor 41 of the step motor 34 turns forward by four switching steps so that, at the time of the subsequent switch-off of the electrical current, it is also in the last stop position, and therefore the yarn guide 25 is in its zero position NS.

At each start of a cross-winding process, this zero position NS respectively represents the initial value for the control device.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for determining a zero position of a yarn guide device of a winding device of a textile machine which is operative for cross-winding a yarn by means of a step motor for producing yarn cheeses, the method comprising the steps of displacing an element of the yarn guide device by the step motor in the direction of the zero position, and positioning the element of the yarn guide device at a comparatively slow speed against a defined detent arranged downstream of the zero position in the direction of the displacement, switching off the step motor for positioning a rotor of the step motor into one of two possible stop positions, and then switching on the step motor by a definite electrical current supply to stator windings of the step motor such that, when again switched off, the rotor of the step motor is in the stop position in which the yarn guide is in its zero position.

2. Apparatus for determining a zero position of a yarn guide device of a winding device of a textile machine which is operative for cross-winding a yarn by means of a step motor for producing yarn cheeses, the apparatus comprising:

an element of the yarn guide device arranged for displacement by the step motor in the direction of the zero position and for positionability at a comparatively slow speed against a defined detent arranged downstream of the zero position in the direction of the displacement, means for switching the step motor on and off for positioning a rotor of the step motor into one of two possible stop positions upon an initial switching off of the step motor and, upon subsequent switching on the step motor by a definite electrical current supply to stator windings of the step motor followed by again switching off the step motor, for positioning the rotor of the step motor in the stop position in which the yarn guide is in its zero position.

3. Apparatus in accordance with claim 2, wherein the step motor comprises a hybrid step motor having a rotor which has an axially magnetized bipolar permanent magnet in a rotor center, and has salient poles at rotor ends in the form of toothed pole caps.

4. The device in accordance with claim 3, wherein the pole caps have twenty-five poles essentially in the form of teeth.

5. The device in accordance with claim 3, wherein the poles of a first pole cap are arranged angularly offset in relation to the poles of a second pole cap.

6. The device in accordance with claim 5, wherein the angular offset between the poles of the first pole cap and the poles of the second pole cap is half a divisional spacing.

7. The device in accordance with claim 3, wherein the stator of the hybrid step motor has stator segments surrounded by windings which can be supplied with an electrical current, wherein one half of the windings are connected to a first phase and the other half of the windings are connected to a second phase of an electrical d.c. current source via a circuit arrangement.

8. The device in accordance with claim 7, wherein each of the stator elements has pole teeth which correspond with the poles of the pole caps of the rotor.

9. The device in accordance with claim 7, wherein the electrical control of the windings in the area of the stator segments is arranged for bipolar operation.

10. The device in accordance with claim 3, wherein a drive wheel for a toothed belt is disposed, fixed against relative rotation, on a motor shaft of the step motor.

11. The device in accordance with claim 10, wherein the drive wheel has forty-eight teeth, and the toothed belt a division of 2 mm.

* * * * *